US005758370A

United States Patent [19]

Schwartz

[11] Patent Number: 5,758,370

[45] Date of Patent: Jun. 2, 1998

[54] FOOT BATH

[76] Inventor: Sam Schwartz, 5000 Whitsett Ave., #102, North Hollywood, Calif. 91607

[21] Appl. No.: 887,733

[22] Filed: Jul. 3, 1997

Related U.S. Application Data

[63] Continuation of Ser. No. 378,451, Jan. 26, 1995, abandoned.

[51] Int. Cl.[6] ..... A47K 3/022

[52] U.S. Cl. ..... 4/622; 36/8.1; 602/13; 604/293

[58] Field of Search ..... 4/619–622; 601/151; 602/13; 604/293; 607/111; 36/8.1, 93, 88, 29

[56] References Cited

U.S. PATENT DOCUMENTS

| | | | |
|---|---|---|---|
| 438,931 | 10/1890 | Martinot | 4/622 |
| 850,603 | 4/1907 | Reiter | 4/622 |
| 1,074,595 | 10/1913 | Aumont | 36/8.1 |
| 2,382,637 | 8/1945 | Jacks | 4/622 |
| 2,565,751 | 8/1951 | Birkle | 36/8.1 X |
| 2,582,648 | 11/1952 | Mowbray | 36/8.1 |
| 3,026,540 | 3/1962 | Barker | 4/622 |
| 3,478,738 | 11/1969 | Altman et al. | 604/293 X |
| 3,785,374 | 1/1974 | Lipson | 602/3 |

FOREIGN PATENT DOCUMENTS

| | | | |
|---|---|---|---|
| 1921004 | 11/1970 | Germany | 4/622 |

*Primary Examiner*—Charles E. Phillips

[57] ABSTRACT

A foot bath formed of a base and a wall which are relatively collapsible wherein the reservoir is empty of fluid and there is no foot in the reservoir. The wall is inflatable by filling the cells with air, and deflatable by removing the air from the wall.

4 Claims, 2 Drawing Sheets

FIG. 6
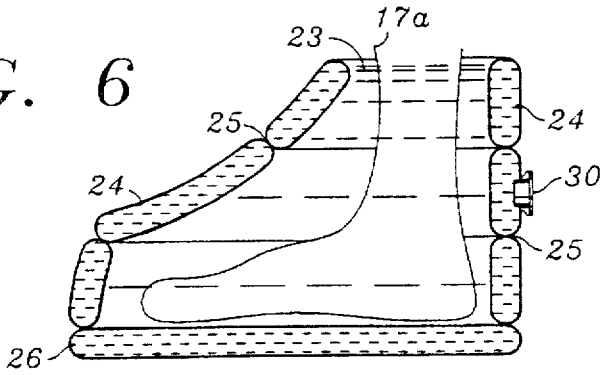
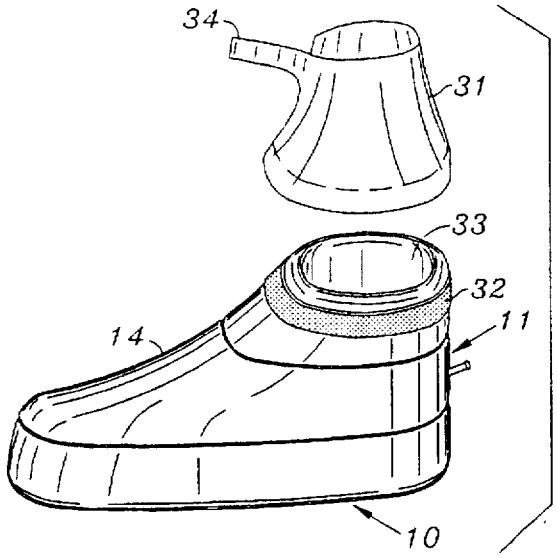
FIG. 7
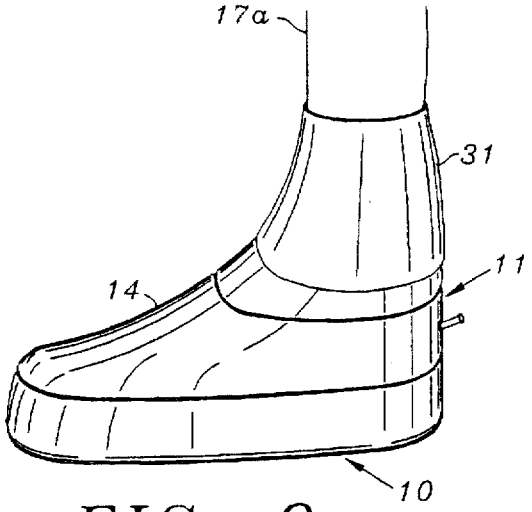
FIG. 8
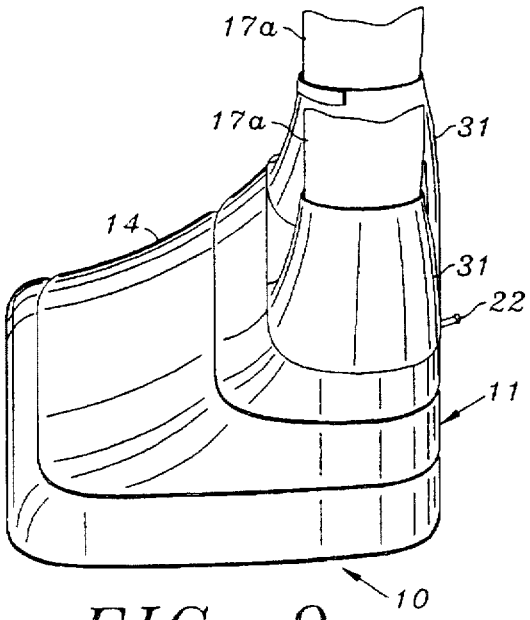
FIG. 9
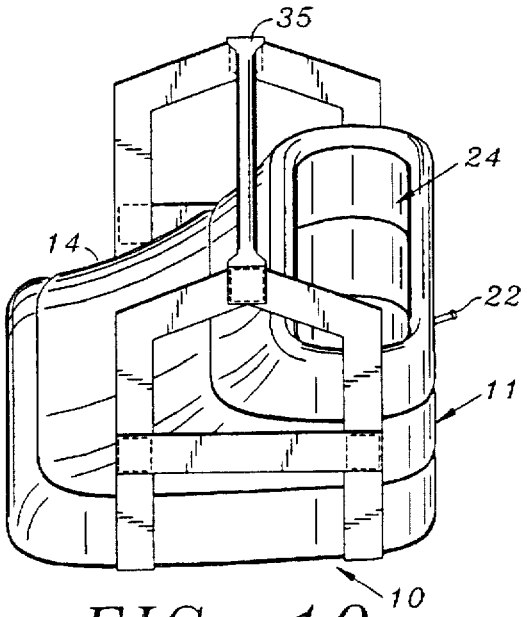
FIG. 10

FOOT BATH

This is a File Wrapper Continuation of application Ser. No. 08/378,451, filed Jan. 26, 1995 now abandoned.

BACKGROUND

Having a foot bath which is adaptable for use in multiple locations is highly desirable.

This invention relates to a foot bath. In particular, it relates to a foot bath which can be easily transported and conveyed for use as desired in different locations.

Using a foot bath into which fluid is placed with invigorating salts, minerals and the like, is highly desirable.

Conventionally, foot baths are formed as a basin made of a rigid plastic material or metal. Warm water with added minerals is then placed into the basin for bathing feet as required.

In view of the structure of the foot bath, it is usually inconvenient to move it to different locations, particularly when users travel to different locations.

This invention is directed to facilitating the use of a foot bath in different locations with a minimum of disadvantage and inconvenience.

SUMMARY

This invention seeks to minimize the disadvantages associated with rigid foot baths.

According to the invention, a bath for a foot includes a base and a wall affixed to the base to form a reservoir for fluid and for receiving a foot. The wall is selectively collapsible relative to the base when the reservoir is empty of fluid and there is no fluid in the reservoir.

In a preferred form of the invention, the wall includes at least one hollow cell inflatable to be upstanding or deflatable to facilitate collapse. Preferably, there are multiple cells for the wall, the cells being connected to form the wall.

A valve is provided for inflating the wall with air and releasing air from the wall to permit deflation of the wall as necessary.

The invention is further described with reference to the accompanying drawings.

DRAWINGS

FIG. 6 is a sectional side view of the bath of FIG. 7, and illustrating a foot and fluid in the bath, with liquid in the cells.

FIG. 7 is a perspective view partially from the too illustrating another form of a foot bath for receiving a single foot with a seperated cover for the lower foot.

FIG. 8 is a perspective view from the front illustrating one form of a foot bath for receiving a single foot with the separated cover in position about the lower foot.

FIG. 9 is a perspective view partially from the top illustrating a different form of a foot bath for receiving two feet with the seperated cover in position about the lower portion of the feet.

FIG. 10 is a perspective view partially from the top illustrating another form of a foot bath for receiving two feet with a handle for carrying the bath.

DESCRIPTION

Figure 1:
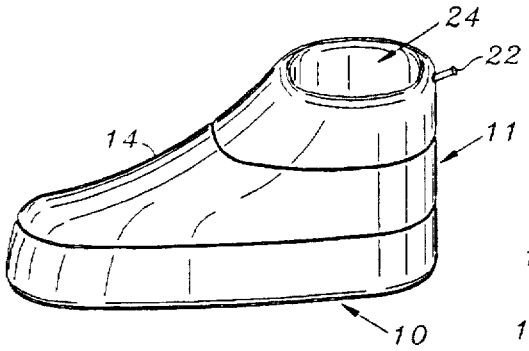
FIG. 1 is a perspective view from the front illustrating one form of a foot bath for receiving a single foot.
Figure 2:
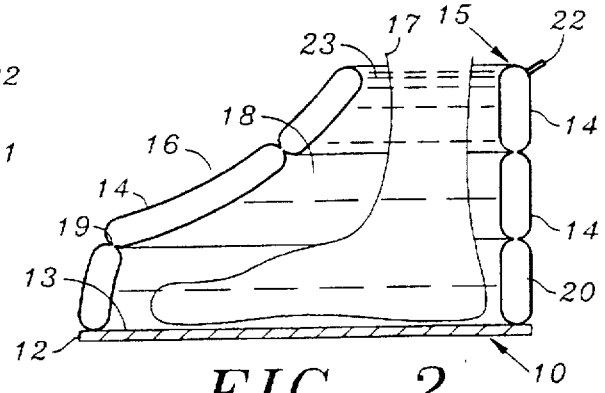
FIG. 2 is a sectional side view of the bath of FIG. 1, and illustrating a foot and fluid in the bath.

In FIG. 1 there is shown a foot bath which includes a base 10 and a wall 11. As illustrated in FIGS. 1 and 2, the base 10 is formed of a relatively thicker material than the wall material. The material is conveniently a PVC which is flexible in the sense that it can be folded as required.

The material 12 forming the base 10 can be any other suitable plastic material. In some cases, the material may also include a substantially cellular or foamed base provided the material includes a surface 13 which is impervious to fluid.

The wall 11 is formed by multiple cells 14 which form a series of ring-like elements shaped to form a wall with a substantially vertical or straight rear face 15, and a contoured shape forward face 16. The contoured shape forward face would be located in front of a foot 17 which is placed in the reservoir 18 formed by the wall 11 and base 10.

The multiple cells 14 are connected at points 19 which are longitudinally directed along the length of each cell. Each of the points 19 is located below and above a respective central bore 20 forming each of the cells 14. There is a passage 21 between each of the cells 14 so that air can pass between the cells 14 as necessary.

A valve 22 is provided at the top of the rear wall 11 so that air can be introduced and removed from the central bore 20 of each of the cells 14. When air is urged into the central bore 20, the wall 11 is inflated to be in a substantially upright form at the rear face 15, and a contoured front face 16. The wall 11 is integrally connected with the base 10. A reservoir 18 is thus formed for shaping the foot bath. The valve 22 also includes an appropriate sealing member to prevent the unintended escape of air. Operating the valve 22 to remove air from the bore 20 deflates the wall 11 as required.

When the wall 11 is inflated, the reservoir 18 is formed to receive the foot 17. Fluid 23 is added as required to provide the requisite relief and treatment, soaking or massaging of the foot 17 as required by the user.

Emptying air from the central bore 20 of the wall 11, and removal of the foot 17 and fluid 23 permits the wall 11 to collapse on the base 10.

Figure 3:
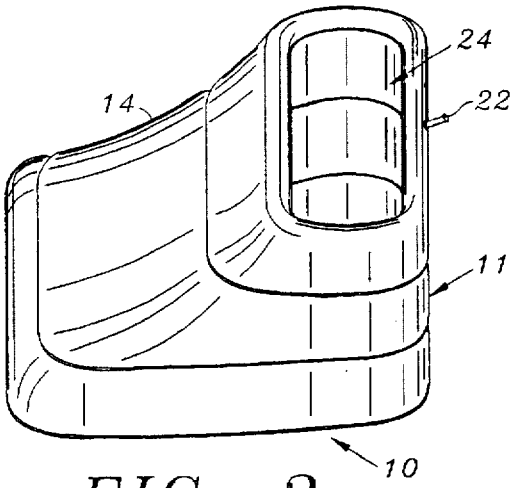
FIG. 3 is a perspective view illustrating a foot bath for receiving two feet.

As illustrated in FIGS. 1 and 2, there are multiple cells 14 which form the wall 11. In the embodiment illustrated in FIGS. 3 and 4, there is a single cell for forming the wall 11 and also the base 10 of the bath. Also, the mouth 24 in FIG. 3 is sufficiently elongated sideways so that two feet 17 can be located in the reservoir 18. Inthe embodiment of FIG. 4 the base 10 is also an inflatable cell.

Figure 4:
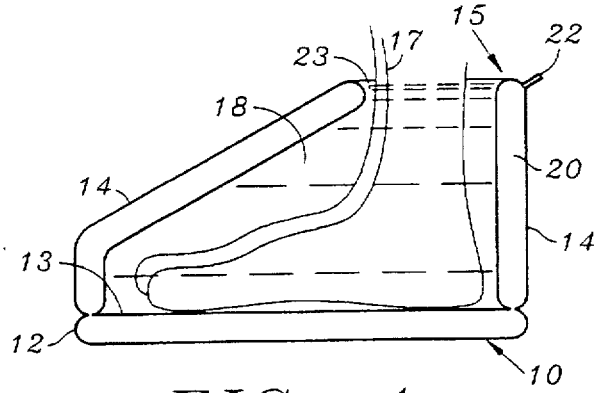
FIG. 4 is a sectional side view of the foot bath of FIG. 3 illustrating two feet and fluid in the bath.

In this sense, the mouth 24 for the embodiment of FIGS. 1 and 2 is relatively smaller so that just the single foot 17 is located in the reservoir 18. As shown in FIG. 1, the mouth is relatively circular. The mouth in FIGS. 3 and 4 is a rectangular structure with rounded ends.

The embodiments of the foot bath are shaped to form relatively a boot-type shape. In this sense, there is a rear wall portion 15 which rises from a sole-type base 10 and extends between 4 to 12 inches as required up the leg. The forward wall portion 16 is contoured to substantially envelope, together with the rear wall 15, the foot 17 and the lower portion of the leg 17*a* as a boot would fit about a foot 17 and the lower portion of the leg 17*a*. The size of the reservoir 18 relative to a foot 17 can vary as necessary.

Ideally the size of the reservoir 18 would be sufficiently large to accommodate feet 17 of different sizes. The embodiment of FIGS. 3 and 4 is effectively a double width boot so as two feet 17 would fit within the reservoir 18 as necessary.

By having the shape of the bath fairly tight or snugly contoured relative to the shape of the foot 17, there is an advantage that less fluid can be used in forming the soaking substance. Additionally, warmth created from the foot 17 itself can more quickly warm the fluid 23 as necessary which can add to improved bathing and treating effects of the foot or the feet as soaked in the bath.

Figure 5:
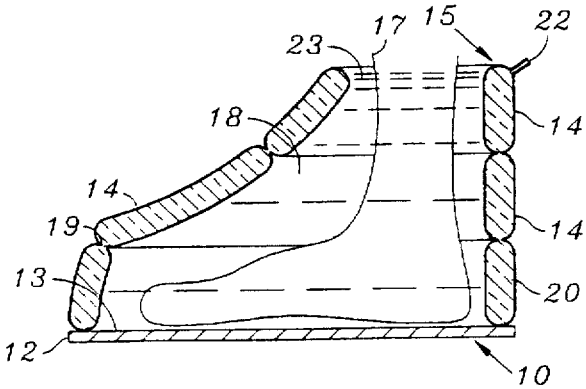
FIG. 5 is a side view of a bath including relatively solid foldable cell members relative to the base.

In FIG. 5, there is shown an embodiment with cells 24 which are formed of relatively non hollow partly solid elements. These cells 24 are interconnected so that they can fold together about points 25 and thereby collapse when the reservoir 18 does not contain a fluid 23 and there is no foot 17 in the reservoir 18. The materials for the cells 24 may be provided by suitable foam-type element, and may be suitably heat insulating as necessary. The base 26 may be formed of a similar foam material.

Many of the forms of the invention exist each differing from the other in matters of detail only.

For instance, in different embodiments of the invention different shapes for the foot bath can be provided. In some situations, the base may be formed by a cell which is also inflatable and deflatable by air so as to enhance the collapsibility of the foot bath. Such an embodiment is shown in FIG. 4.

Also, the thickness of the different materials forming the base and walls may be varied, as necessary. One or more valves may be provided for the configuration, and the size of the cells may vary in cross-section as necessary. For instance, the cells may be of a uniform cross-section towards the rear back of the heel or rear or the leg, and be substantially larger in the front portion over the forward portion of the foot and forward portion of the leg. In other forms of the embodiments the cells are different to ring formations. Each of the cells may extend partially around the foot and be suitably interconnected as multiple cells to surround the foot. The configuration should be ideally formed to facilitate drying of the reservoir without residual fluid in the reservoir after use.

In different forms of the invention the cells may be filled with liquid as shown in FIG. 6 such as warm or hot water or other fluid. This water will have the effect of acting as a heater to the foot and water in the bath, and acting as an insulator for the water and the foot inside the reservoir. Further by filling the walls with liquid rather than air the water in the walls acts for multiple purposes. To facilitate filling and emptying the cells with water there is provided a plug 30 to one of the interconnected cells.

In yet other variations as shown in FIGS. 7,8 and 9, there can be provided a cover 31 to avoid splashing of water from the reservoir. The cover 31 can be provided with one segment of a Velcro (TM) portion. The other portion 32 of the Velcro (TM) can be provided about the mouth 33 and a strap portion 34 which can be wrapped around the bottom portion 17*a* of the leg.

As shown in FIG. 10, there can also be a detachable strap 35 to facilitate carrying the bath. This would facilitate carrying the bath to empty the reservoir of water, and cells of water when the cells are waterfilled, after use.

The material for the walls and cells may be relatively inexpensive so that the bath can be considered disposable after one or a few times of usage.

What is claimed is:

1. A bath forming a reservoir for two feet located in adjacency, the bath including:

a base and a wall attached thereto;

the wall being formed from multiple hollow ring-like cells;

a) a first ring-like cell being attached to the base in an essentially upright manner with respect thereto;

b) at least a second ring-like cell being attached to the first ring-like cell so as to form an essentially upright rear face and an essentially contoured forward face being substantially obliquely angled with respect to the base and the rear face, the at least second ring-like cell forming a mouth for receiving the feet of a user, wherein a space is created for the fluid above the feet and around the lower portion of the legs of the user;

the wall being selectively collapsible relative to the base when the reservoir is empty and there are no feet in the reservoir, the cells being inflatable to be upstanding from the base and being deflatable to facilitate the collapse;

each cell having an area for connection to an adjacent cell, each said area having a passage for an inflation medium to pass between the cells; and a cover for the mouth, the cover being noninflatable and being attached to the inflatable wall, and the noninflatable cover surrounding the lower portion of the legs when the feet are in the bath to thereby, with both legs in location, effect closure of the mouth.

2. A bath as claimed in claim 1 wherein the base is formed of material relatively thicker than a material for the wall.

3. A bath as claimed in claim 1 wherein the material for the wall is a polyvinyl chloride material, and including means for carrying the bath.

4. A bath as claimed in claim 1 wherein the wall has a forward face which includes a substantially contoured portion, the contoured portion being for location substantially in front of feet located in the bath, the contoured portion including curves substantially following the top portion of the feet.

* * * * *